United States Patent [19]

Bayless

[11] 4,083,483

[45] Apr. 11, 1978

[54] SHOE HOLDER

[76] Inventor: Norman Gene Bayless, 7964 SW. 7th St., N. Lauderdale, Fla. 33063

[21] Appl. No.: 730,698

[22] Filed: Oct. 8, 1976

[51] Int. Cl.[2] ..... B65D 71/00

[52] U.S. Cl. ..... 224/45 R; 206/278; 220/4 E; 220/335

[58] Field of Search ..... 150/52 R; 211/34–38; 312/294, 299, 301; 220/4 E, 335; 206/44.12, 278, 299, 563, 562; 224/45 R, 45 S, 47

[56] References Cited

U.S. PATENT DOCUMENTS

| | | | |
|---|---|---|---|
| 1,909,942 | 5/1933 | Fingerman | 150/DIG. 1 |
| 2,109,034 | 2/1938 | Seifer | 224/45 P |
| 3,696,850 | 10/1972 | Rosenblum | 190/58 A X |
| 3,721,373 | 3/1973 | Penniman | 224/5 R |

FOREIGN PATENT DOCUMENTS

| | | | |
|---|---|---|---|
| 1,228,996 | 11/1966 | Germany | 206/299 |
| 236,283 | 7/1971 | Germany | 220/4 E |

*Primary Examiner*—Drayton E. Hoffman
*Assistant Examiner*—Donald W. Underwood
*Attorney, Agent, or Firm*—Malin & Haley

[57] ABSTRACT

A combined shoe holder and carrier having a pair of front and rear covers made from some lightweight rigid material. Each front and rear cover is attached together by an adjustable fastener which allows them to move in relation to each other thereby varying their size. A biasing spring hinge means attached to the bottom of the covers maintains the shoes in either a flat position or a folded position. The shoe holder has extendable handles which permit either carrying or hanging during storage. Flat heel and sole portions permit standing the shoe holder in an upright, vertical position or lying it in a flat, horizontal position. A bolt, whose head is permanently mounted to the inside of one cover, slides in and extends through a groove in the other cover, and varies the size of the shoe holder with an adjusting unit. A detachable cover extends over the opening in the top of the shoe holder.

7 Claims, 4 Drawing Figures

SHOE HOLDER

BACKGROUND OF THE INVENTION

Various types of devices are commonly used to hold shoes in a fixed position for storage. One such device is the Crawford invention U.S. Pat. No. 2,587,971. Other devices are commonly used to hold shoes on a fixed, rigid base in a side by side position for carrying. One such device is the Purdy invention, U.S. Pat. No. 3,368,655.

SUMMARY

This invention relates generally to a portable device for holding, carrying and protecting shoes, more particularly to a shoe holder which can be maintained in a flat position or be biased in a folded position.

It is an object of this invention to provide a shoe holder which permits the shoes to be carried in a protective device, thereby preventing damage to the shoes and preventing other items from being damaged by the shoes.

It is another object of this invention to provide a shoe holder that can be carried or stored in either a flat position, with the shoes mounted in a side-by-side relationship, or in a folded position, with the shoes mounted in a sole-to-sole relationship.

It is another object of this invention to have the shoe holder split, such that the rear cover can slide relative to the front cover, thereby allowing various size shoes to be carried.

It is a further object of this invention to have a flat bottom portion and a flat back portion to permit the shoe holder to remain in a horizontal position or in a vertical position.

It is still a further object of this invention to have a handle which can be used for carrying the shoes or hanging the shoes during storage. This handle is maintained in the desired position by a frictional spring device.

In accordance with these and other objects which will be apparent hereinafter, the instant invention will now be described with particular reference to the accompanying drawings.

BRIEF DESCRIPTION OF THE DRAWINGS

The present invention is herein described and illustrated with respect to particular preferred embodiments thereof, as illustrated in the accompanying drawings wherein.

DESCRIPTION OF THE PREFERRED EMBODIMENT

Figure 1:
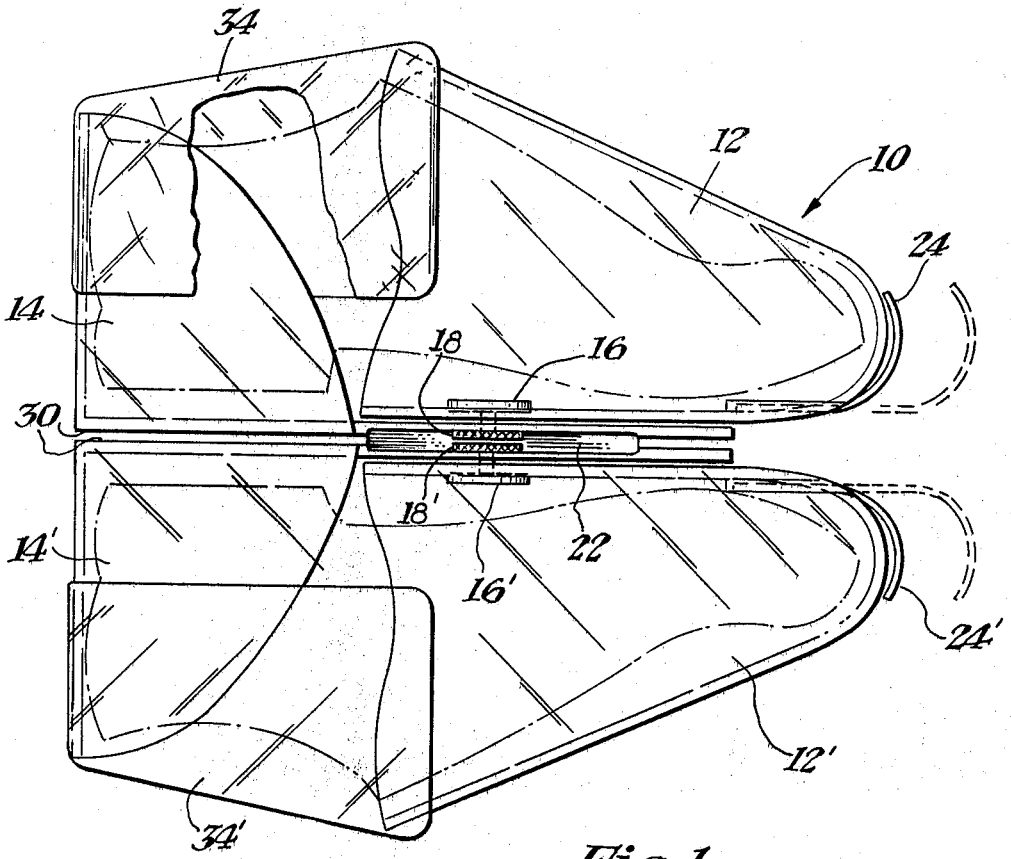
FIG. 1 is a side view of the present invention shown in the folded position.
Figure 2:
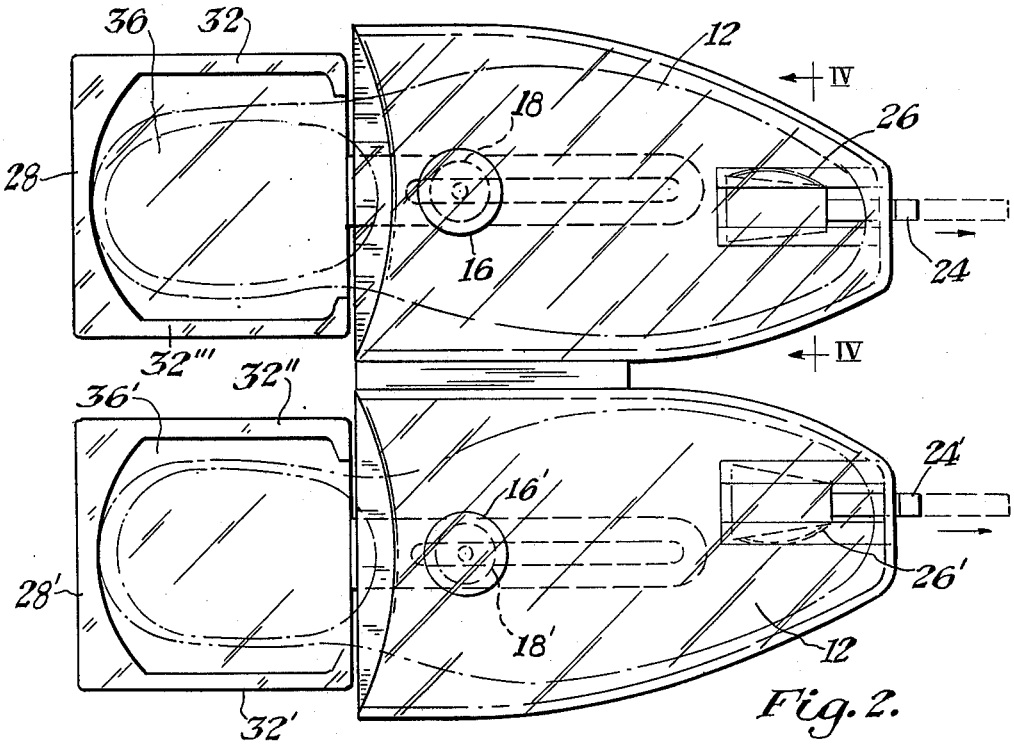
FIG. 2 is a top view of the present invention shown in the flat position, with a cut-away section showing the internal portion of the handle.
Figure 3:
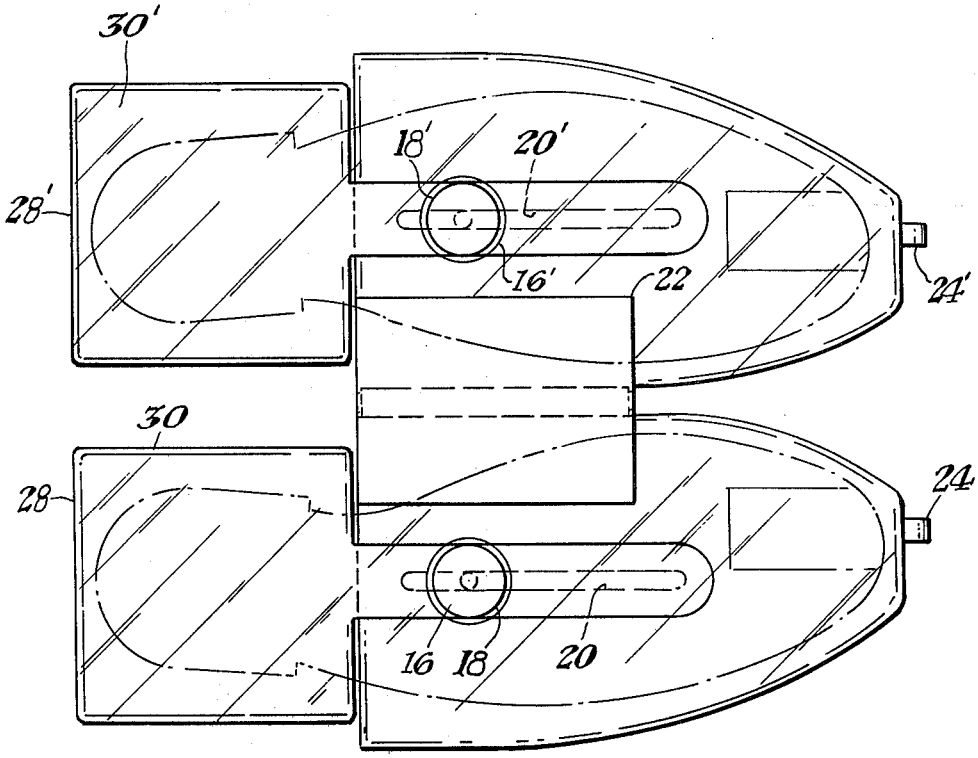
FIG. 3 is a bottom view of the present invention shown in the flat position.

Considering now the present invention in some detail and referring to the drawings, it is noted that in FIGS. 1, 2 and 3 there is illustrated an embodiment of the present invention consisting of two cover means including two front cover means 12, 12' and two rear cover means 14, 14' for holding shoes. This cover can be made of any lightweight, durable and rigid material, for example, polyvinyl plastic or aluminum, but not limited to such. The front cover means 12, 12' are shaped to receive and protectively encase the front portion of a shoe on the top, bottom, front and two sides while the rear covers 14, 14' are shaped to encase the heel portion of a shoe on the bottom, rear and two sides, but with the top open 36, 36' to allow the insertion of the shoe into the holders.

Each front cover means includes a top portion, a bottom portion, a front portion and two side portions. Each rear cover means includes a bottom portion, a rear portion and two side portions.

The front covers 12, 12' have bolts 16, 16' fixed securely and permanently to the inside bottom of said covers 12, 12' in such a manner that the heads shall not rotate within the front covers 12, 12' while nuts 18, 18' are tightened on the portion of said bolts 16, 16' that extend downward and through the rear covers 14, 14'. The shanks of said bolts 16, 16' fit into cut-outs 20, 20' which permit the rear covers 14, 14' to slide relative to the front covers 12, 12', thereby allowing various size shoes to be carried, and maintained when the nuts 18, 18' are tightened.

The front covers 12, 12' also have a hinge 22 fastened to them which secures the right cover 12' to the left cover 12 and which is biased such that the shoe holder 10 will either be maintained and biased into a side-by-side position or in a folded position, sole-to-sole. Said hinge has a spring biasing means which is unstable between the side-by-side position and the sole-to-sole position.

Figure 4:
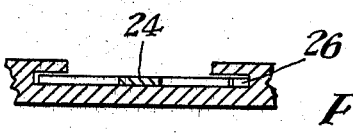
FIG. 4 is a sectional view of the present invention taken along the plane A-A', showing the detail of the sliding handle.

The front covers 12, 12' also have handles 24, 24' that extend through apertures in the toe sections which may be maintained either in a position, flush against the front covers 12, 12' or may be extended when carrying said shoe holder 10. Said handles 24, 24' may be used to hang-up said shoe holder 10 for storage when said handles 24, 24' are in the fully extended position. The internal portion of the handles 24, 24' as shown in FIG. 4 is held in the desired position by frictional retaining springs 26, 26'.

The rear covers 14, 14' are shaped such that the back panels 28, 28' are flat and at right angles to the bottom 20, 20' and side 32, 32', 32'', 32''' panels of said covers which are also flat. This configuration allows the shoe holder 10 to be stored in a vertical position or a horizontal position. The longitudinal axis of each shoe holder and carrier may be positioned vertically or horizontally.

FIG. 1 shows a flexible, detachable cover 34, 34' which extends over the openings 36, 36' in the top of the shoe holder 10. Connecting means such as snap means may be attached to the shoe holder and cover.

The instant invention has been shown and described herein in what is considered to be the most practical and preferred embodiment. It is recognized however, that departures may be made therefrom within the scope of the invention and that obvious modifications will occur to a person skilled in the art.

What is claimed is:

1. A combined shoe holder and carrier comprising:

two cover means including;

two front cover means to encompass the front portion of a pair of shoes, each said front cover means including a front portion, a top portion, a bottom portion and two side portions connected together to provide a rear opening;

two rear cover means to engage the rear portion of the pair of shoes to hold the front portion of the pair of shoes in said two front cover means each said rear cover means including a bottom portion, a rear portion and two side portions connected together to provide a top and front opening;

each said front cover means moveably connected by an adjustable connecting means to a corresponding rear cover means for relative adjustable movement in relation to each other for receiving and holding various sized shoes;

a hinge means connected between said two cover means; and, a handle means connected to at least one of said front cover means.

2. A combined shoe holder and carrier comprising;

two front cover means to cover the front portion of a pair of shoes, each said front cover means including a front portion, a top portion, a bottom portion and two side portions;

two rear cover means to hold said pair of shoes in said shoe holder and carrier, each said rear cover means including a bottom portion, a rear portion and two side portions;

connecting means positioned between each front cover means and each rear cover means, said connecting means including a locking means with a fixed bolt connected to one front cover means and an adjustable nut connected to one rear cover means, a hinge means connected between said front cover means; and, a handle means connected to at least one of said front cover means.

3. A combined shoe holder and carrier as set forth in claim 1, including:

handle means connected to each said front portion and adjustable from a flush position with said front portion to an extended position, said handle means maintained in a desired position by a retaining means.

4. A combined shoe holder and carrier as set forth in claim 1, wherein:

the rear portions of said two rear cover means and the bottom portions of said two rear cover means and the bottom portion of said two front cover means are generally flat to allow vertical or horizontal storage of the shoe holder and carrier.

5. A combined shoe holder and carrier as set forth in claim 1, wherein:

said hinge means is connected between said two cover means and is biased to maintain said front and rear cover means in either a side-to-side relation or a bottom-to-bottom relation.

6. A combined shoe holder and carrier comprising:

two front cover means to cover the front portion of a pair of shoes, each said front cover means including a front portion, a top portion, a bottom portion and two side portions;

two rear cover means to hold said pair of shoes in said shoe holder and carrier; each said rear cover means including a bottom portion, a rear portion and two side portions; to one rear cover means;

a hinge means, said hinge means is connected between said two cover means and is biased to maintain said front and rear cover means in either a side-to-side relation or a bottom-to-bottom relation; and a handle means connected to at least one of said front cover means.

7. A combined shoe holder and carrier comprising:

two cover means including; two front cover means to cover the front portion of a pair of shoes, each said front cover means including a front portion, a top portion, a bottom portion and two side portions;

two rear cover means to hold said pair of shoes in said shoe holder and carrier, each said rear cover means including a bottom portion, a rear portion and two side portions;

connecting means positioned between each front cover means and each rear cover means, said connecting means including a locking means with a fixed bolt connected to one front cover means and an adjustable nut connected to one rear cover means;

a hinge means, said hinge means is connected between said two cover means and is biased to maintain said front and rear cover means in either a side-to-side relation or a bottom-to-bottom relation; and a handle means, said handle means connected to each said front portion and adjustable from a flush position with said front portion to an extended position.

* * * * *